US010219098B2

(12) United States Patent
Tzirkel-Hancock et al.

(10) Patent No.: US 10,219,098 B2
(45) Date of Patent: Feb. 26, 2019

(54) LOCATION ESTIMATION OF ACTIVE SPEAKER

(71) Applicants: GM Global Technology Operations LLC, Detroit, MI (US); Bar-Ilan University, Ramat Gan (IL)

(72) Inventors: Eli Tzirkel-Hancock, Ra'anana (IL); Vladimir Tourbabin, Beer-Sheva (IL); Ilan Malka, Tel Aviv (IL); Sharon Gannot, Ramat-HaSharon (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/707,299

(22) Filed: Sep. 18, 2017

(65) Prior Publication Data

US 2018/0255418 A1 Sep. 6, 2018

Related U.S. Application Data

(60) Provisional application No. 62/466,566, filed on Mar. 3, 2017.

(51) Int. Cl.

| | |
|---|---|
| ***H04S 7/00*** | (2006.01) |
| ***H04R 3/00*** | (2006.01) |
| ***H04R 1/40*** | (2006.01) |

(52) U.S. Cl.

CPC ..... *H04S 7/305* (2013.01); *H04R 1/406* (2013.01); *H04R 3/005* (2013.01); *H04R 2201/401* (2013.01)

(58) Field of Classification Search

CPC ..... H04S 7/305; H04R 1/406; H04R 3/005; H04R 2201/401

(Continued)

(56) References Cited

U.S. PATENT DOCUMENTS 5,774,562 A * 6/1998 Furuya ..... H04M 9/08 379/406.06
2005/0031129 A1* 2/2005 Devantier ..... H04S 7/301 381/58

(Continued)

OTHER PUBLICATIONS

Xiaofei Li, Laurent Girin, Radu Horaud, and Sharon Gannot, Estimation of the Direct-Path Relative Transfer Function for Supervised Sound-Source Localization, IEEE/ACM Transactions on Audio, Speech, and Language Processing, vol. 24, No. 11, Nov. 2016.*

(Continued)

*Primary Examiner* — Vivian Chin
*Assistant Examiner* — Friedrich W Fahnert
(74) *Attorney, Agent, or Firm* — Cantor Colburn LLP

(57) ABSTRACT

A system and method to perform an estimation of a location of an active speaker in real time includes designating a microphone of an array of microphones as a reference microphone. The method includes storing a relative transfer function (RTF) for each microphone of the array of microphones other than the reference microphone associated with each potential location among potential locations as a set of stored RTFs, and obtaining a voice sample of the active speaker and obtaining a speaker RTF for each microphone of the array of microphones other than the reference microphone. The method also includes performing an RTF projection of the speaker RTF for each microphone on the set of stored RTFs, and determining one of the potential locations as the location of the active speaker based on the performing the RTF projection.

18 Claims, 3 Drawing Sheets

(58) Field of Classification Search
USPC ..... 381/56, 58, 66, 71.4, 86, 92, 98, 120, 381/302, 313, 315; 704/215, 233, 240; 700/94
See application file for complete search history.

(56) References Cited

U.S. PATENT DOCUMENTS

| | | | | |
|---|---|---|---|---|
| 2005/0080619 | A1* | 4/2005 | Choi | G01S 3/8006 704/215 |
| 2014/0286497 | A1* | 9/2014 | Thyssen | H04R 3/005 381/66 |
| 2015/0012268 | A1* | 1/2015 | Nakadai | G10L 15/20 704/233 |
| 2015/0163602 | A1* | 6/2015 | Pedersen | H04R 25/407 381/315 |
| 2015/0256956 | A1* | 9/2015 | Jensen | H04R 25/30 381/56 |
| 2015/0310857 | A1* | 10/2015 | Habets | G10L 25/78 704/240 |
| 2016/0293179 | A1* | 10/2016 | Thiergart | H04R 3/005 |
| 2017/0078819 | A1* | 3/2017 | Habets | H04S 7/30 |
| 2018/0041849 | A1* | 2/2018 | Farmani | H04R 25/552 |
| 2018/0054683 | A1* | 2/2018 | Pedersen | H04R 25/405 |

OTHER PUBLICATIONS

Xiaofei Li1, Radu Horaud1, Laurent Girin, Local Relative Transfer Function for Sound Source Localization, 2015 23rd European Signal Processing Conference (EUSIPCO).*

* cited by examiner

LOCATION ESTIMATION OF ACTIVE SPEAKER

CROSS-REFERENCE TO RELATED APPLICATION

This application claims the benefit of priority from U.S. Provisional Application No. 62/466,566 filed Mar. 3, 2017, the disclosure of which is incorporated herein by reference in its entirety.

INTRODUCTION

The subject disclosure relates to location estimation of an active speaker.

There are many situations in which determining the location of a source of sound is useful. Acoustic sensors are used to estimate the location of a seismic event, for example. In another type of application, an array of microphones may be arranged to obtain sound for amplification, recording, or transmission. In such a case, the parameters of a known beamforming algorithm that is applied to the array of microphones can be estimated based on a particular location of interest. For example, beamforming can be performed such that the microphones of the array are focused on a speaker on a panel or a soloist within an orchestra. In an exemplary vehicle application, beamforming can be performed on the array of microphones based on whichever of the vehicle occupants is currently speaking. Performing beamforming on the microphones facilitates a reduction in noise and improved voice recognition, for example. However, using a beamforming algorithm requires an accurate estimation of the position of the speaker in real time (i.e., the active speaker). Accordingly, it is desirable to provide a method and system to determine the location of a speaker in real time.

SUMMARY

In one exemplary embodiment, a method of performing an estimation of a location of an active speaker in real time includes designating a microphone of an array of microphones as a reference microphone, and storing a relative transfer function (RTF) for each microphone of the array of microphones other than the reference microphone associated with each potential location among potential locations as a set of stored RTFs. The method also includes obtaining a voice sample of the active speaker and obtaining a speaker RTF for each microphone of the array of microphones other than the reference microphone, and performing an RTF projection of the speaker RTF for each microphone on the set of stored RTFs. One of the potential locations is determined as the location of the active speaker based on the performing the RTF projection.

In addition to one or more of the features described herein, obtaining the voice sample is performed in real time.

In addition to one or more of the features described herein, a sound is sampled from each of the potential locations to obtain the set of stored RTFs.

In addition to one or more of the features described herein, the set of stored RTFs is obtained as the RTF for each microphone of the array of microphones other than the reference microphone based on computing, for each of the potential locations, a ratio of an acoustic transfer function from one potential location among the potential locations to the microphone to an acoustic transfer function from the one potential location among the potential locations to the reference microphone.

In addition to one or more of the features described herein, obtaining the speaker RTF for each microphone of the array of microphones other than the reference microphone includes computing, for each of the potential locations, a ratio of an acoustic transfer function of the voice sample at the microphone to an acoustic transfer function of the voice sample at the reference microphone.

In addition to one or more of the features described herein, performing the RTF projection includes calculating a cosine distance between each speaker RTF and each RTF of the set of stored RTFs.

In addition to one or more of the features described herein, determining the location of the active speaker is based on the maximum of the cosine distances.

In addition to one or more of the features described herein, storing the set of stored RTFs for the potential locations includes storing the set of stored RTFs for each seat in an automobile.

In addition to one or more of the features described herein, storing the set of stored RTFs is part of a calibration process performed for the automobile.

In addition to one or more of the features described herein, storing the set of stored RTFs is part of a calibration process performed for a calibration automobile of a same model as the automobile.

In another exemplary embodiment, a system to estimate a location of an active speaker includes a memory device to store a relative transfer function (RTF) for each microphone of an array of microphones other than a reference microphone associated with each potential location among potential locations as a set of stored RTFs. The system also includes a processor to obtain a voice sample of the active speaker and obtain a speaker RTF for each microphone of the array of microphones other than the reference microphone, perform an RTF projection of the speaker RTF for each microphone on the set of stored RTFs, and determine one of the potential locations as the location of the active speaker based on the RTF projection.

In addition to one or more of the features described herein, the processor obtains the voice sample in real time.

In addition to one or more of the features described herein, the processor samples a sound from each of the potential locations to obtain the set of stored RTFs.

In addition to one or more of the features described herein, the processor obtains the set of stored RTFs as the RTF for each microphone of the array of microphones other than the reference microphone based on computing, for each of the potential locations, a ratio of an acoustic transfer function from one potential location among the potential locations to the microphone to an acoustic transfer function from the one potential location among the potential locations to the reference microphone.

In addition to one or more of the features described herein, the processor obtains the speaker RTF for each microphone of the array of microphones other than the reference microphone based on computing, for each of the potential locations, a ratio of an acoustic transfer function of the voice sample at the microphone to an acoustic transfer function of the voice sample at the reference microphone.

In addition to one or more of the features described herein, the processor performs the RTF projection by calculating a cosine distance between each speaker RTF and each RTF of the set of stored RTFs.

In addition to one or more of the features described herein, the processor determines the location of the active speaker based on the maximum of the cosine distances.

In addition to one or more of the features described herein, the memory device stores the set of stored RTFs for each seat in an automobile.

In addition to one or more of the features described herein, the memory device stores the set of stored RTFs as part of a calibration process performed for the automobile.

In addition to one or more of the features described herein, the memory device stores the set of stored RTFs as part of a calibration process performed for a calibration automobile of a same model as the automobile.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

The following description is merely exemplary in nature and is not intended to limit the present disclosure, its application or uses.

As previously noted, estimating the location of a speaker can be useful. In an exemplary vehicle application, estimating the seat of a speaker can facilitate using a beamforming algorithm on an array of microphones. Estimating the seat location of a speaker may facilitate other applications, as well. Embodiments of the systems and methods detailed herein relate to using relative transfer functions (RTFs) to estimate the location of a speaker. For explanatory purposes, the exemplary case of determining the seat location of a speaker in an automobile is specifically detailed. However, the embodiments detailed herein are applicable to any scenario in which potential speaker locations have been identified for calibration.

Figure 1:
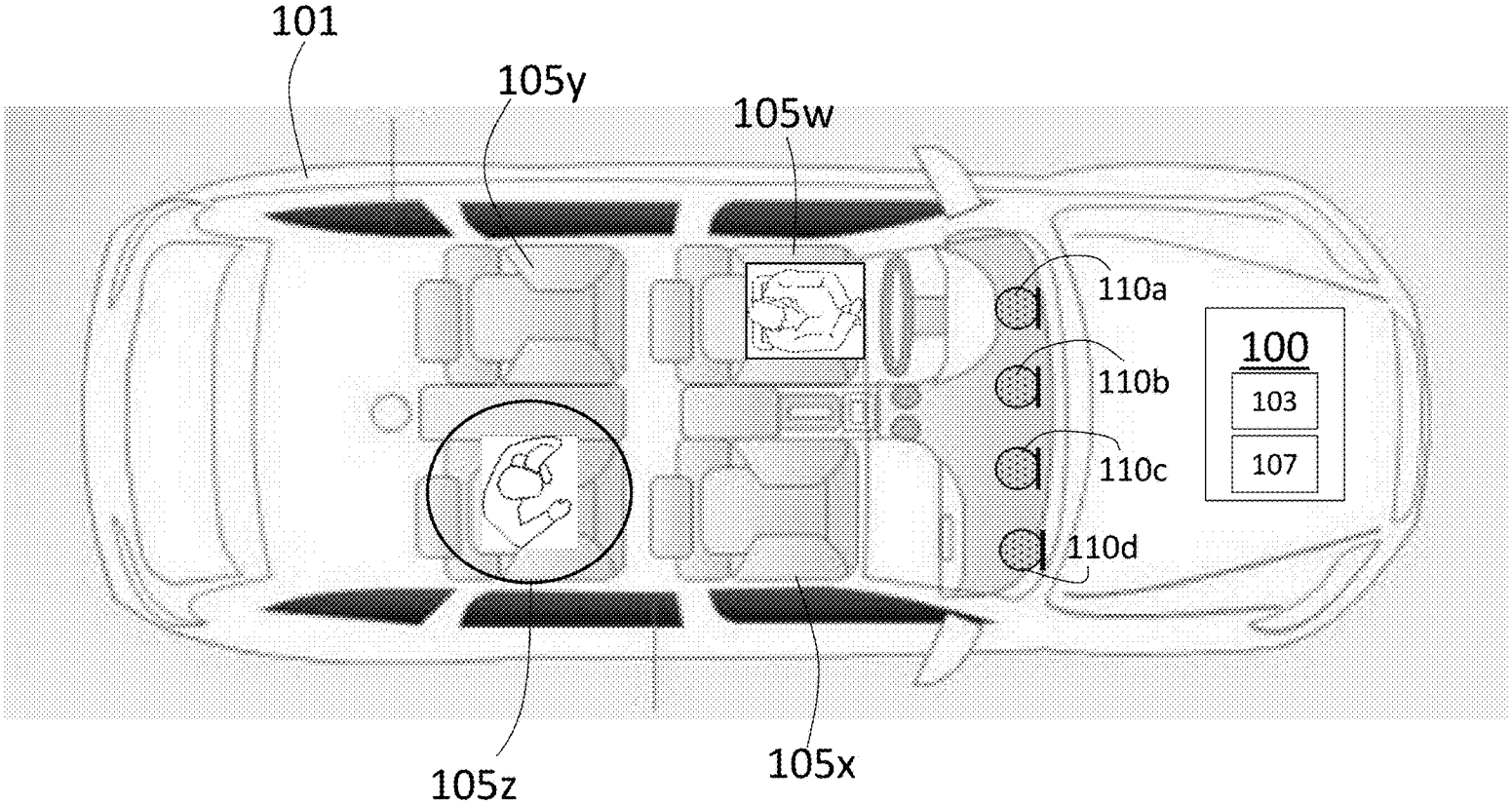
FIG. 1 shows a system to estimate the location of a speaker according to one or more embodiments.

In accordance with an exemplary embodiment, FIG. 1 shows a system to estimate the location of a speaker. A vehicle 101 is shown with four potential speaker locations 105*w*, 105*x*, 105*y*, and 105*z* (generally, 105). Two occupants are shown in the vehicle 101. The occupants are in locations 105*w* and 105*z*. Either of the occupants can speak at any given time. The vehicle 101 includes an array of microphones 110*a*, 110*b*, 110*c*, and 110*d* (generally, 110). While four microphones 110 arranged in a row are shown for the exemplary array in FIG. 1, any number of microphones in any arrangement can be used. However, the same arrangement of microphones 110 and potential locations 105 must be used during the calibration process discussed with reference to FIG. 2. When one of the occupants speaks, determining which one is speaking (i.e., estimating the location 105 in which the speaker is sitting) facilitates performing beamforming with the array of microphones 110. A controller 100 makes the determination according to one or more embodiments.

The controller 100 includes processing circuitry that may include an application specific integrated circuit (ASIC), an electronic circuit, a processor (e.g., processor 107) (shared, dedicated, or group) and memory (e.g., memory device 103) that executes one or more software or firmware programs, a combinational logic circuit, and/or other suitable components that provide the described functionality.

Figure 2:
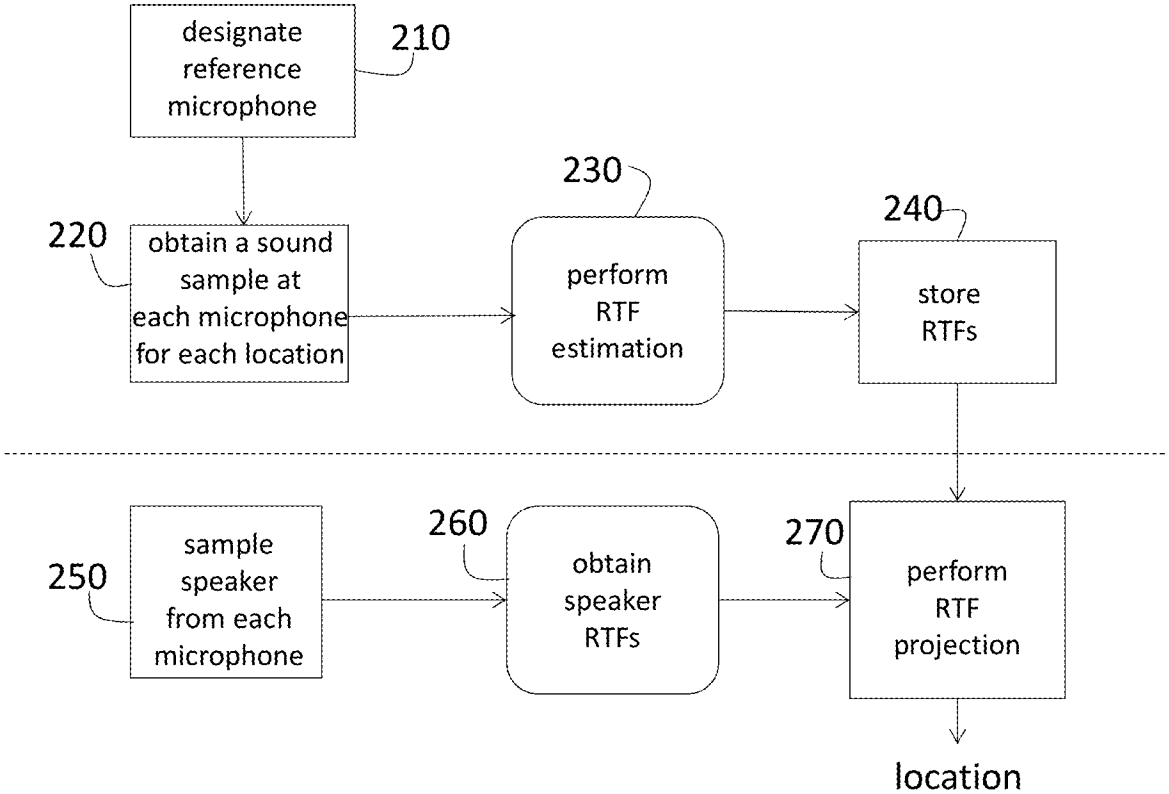
FIG. 2 is a process flow of a method of performing location estimation of a speaker according to one or more embodiments.

FIG. 2 is a process flow of a method of determining the location 105 of an active speaker according to one or more embodiments. The dashed line in FIG. 2 separates processes 210, 220, 230, and 240, which relate to a calibration process, from the processes beginning with block 250, which relate to real-time operation. As previously noted, the same relative arrangement of locations 105 and microphones 110 that is used in the calibration process must be present during the real-time processes. In the exemplary case in which the location 105 of a speaker is determined in a vehicle 101, the calibration process may be performed once for a model of a vehicle 101, for example. Thus, each vehicle 101 of the same model need not undergo the calibration process again.

At block 210, designating a reference microphone 110 refers to identifying one of the microphones 110 in the array as a reference microphone 110. For example, microphone 110*a* in the exemplary array shown in FIG. 1 may be designated as the reference microphone 110. At block 220, the processes include obtaining a sound sample at each microphone 110 for each location 105. As previously noted, the calibration may be performed once for the model of the vehicle 101. Thus, a sound sample is obtained at each microphone 110 from each location 105*w*, 105*x*, 105*y*, and 105*z* during the calibration process even though the exemplary real-time configuration shown in FIG. 1 includes occupants in only locations 105*w* and 105*z*.

Performing RTF estimation, at block 230, essentially refers to obtaining an RTF value for each non-reference microphone 110 associated with each location 105. The RTF estimation can be performed according to different embodiments, one of which is detailed with reference to FIG. 3. At block 240, storing the RTFs completes the calibration process.

At block 250, sampling a speaker from each microphone 110 is done when one of the occupants in the vehicle 101 starts speaking. Obtaining speaker RTFs, at block 260, refers to obtaining the RTF for each non-reference microphone 110 associated with the speaker. Performing RTF projection, at block 270, involves using the RTFs stored at block 240 as part of the calibration process and the speaker RTFs obtained at block 260. Essentially, the controller 100 calculates a cosine distance between the stored RTFs (at block 240) and obtained speaker RTFs (at block 260) and determines the location 105 of the speaker based on the cosine distances.

The cosine distance is given by:

$$D_i(l,k) = \frac{\left|\hat{C}(l,k)^H \cdot C^i(k)\right|}{\left\|\hat{C}(l,k)^H\right\| \cdot \left\|C^i(k)\right\|} \quad \text{[EQ. 1]}$$

D is the cosine distance, i is an index for each location 105 that was calibrated, l is the index of time, and k is the index of frequency. C is a column vector of RTFs, where $\hat{C}$ refers to the speaker RTFs obtained in the operational mode for an active speaker. H indicates a conjugate transpose. Once the cosine distance is obtained for each potential location 105, the location I(l) is determined as the location 105 that provides the maximum cosine distance location 105 of the active speaker. Specifically, assuming that only one occupant is speaking, the location, I(l), is determined as:

$$I(l) = \arg\max_{i} \sum_{k} D_i(l, k) \quad \text{[EQ. 2]}$$

Figure 3:
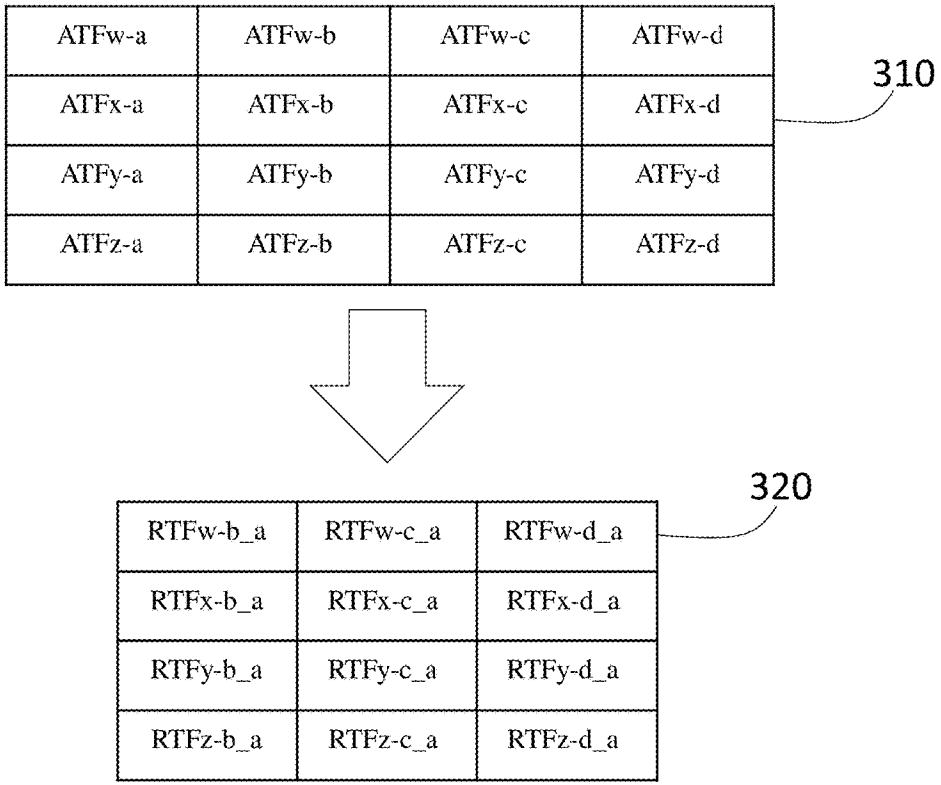
FIG. 3 details processes associated with performing the location estimation as part of the calibration process according to one or more embodiments.

FIG. 3 details processes associated with performing RTF estimation, at block 230, as part of the calibration process. The exemplary case discussed for explanatory purposes is the arrangement shown in FIG. 1 with microphone 110*a* designated as the reference microphone. According to the exemplary embodiment, the acoustic transfer function (ATF) is determined for every microphone 110, including the reference microphone 110*a*, based on a sound source at each location 105. The ATF values associated with each microphone 110*a*, 110*b*, 110*c*, 110*d* for a sound source at each location 105*w*, 105*x*, 105*y*, 105*z* are shown in table 310. Each acoustic transfer function value provides the relationship between a sound level at a given location 105 (at the source of the sound) and the sound level at a given microphone 110. Measurement of ATF according to multiple methods is known and is not further detailed herein. The ATF values associated with the reference microphone 110*a* for each of the locations 105*w*, 105*x*, 105*y*, 105*z* are reference ATF values ATFw-a, ATFx-a, ATFy-a, ATFz-a in table 310.

After the ATF values in table 310 are obtained, the RTF for each non-reference microphone 110 (microphones 110*b*, 110*c*, 110*d*) associated with each location 105*w*, 105*x*, 105*y*, 105*z* is a ratio of the acoustic transfer function to the reference acoustic transfer function associated with that same location. The RTF values are indicated in table 320. As an example, RTFx-c_a is the ratio of the ATF of microphone 110*c* for location 105*x* (ATFx-c) to the ATF of the reference microphone 110*a* for the same location 105*x* (ATFx-a).

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A method of performing an estimation of a location of an active speaker in real time, the method comprising:

designating any one microphone of an array of microphones as a reference microphone;

storing a relative transfer function (RTF) for each microphone of the array of microphones other than the reference microphone associated with each potential location among potential locations as a set of stored RTFs;

obtaining a voice sample of the active speaker and obtaining a speaker RTF for each microphone of the array of microphones other than the reference microphone;

performing an RTF projection of the speaker RTF for each microphone on the set of stored RTFs; and Determining, using a processor, one of the potential locations as the location of the active speaker based on the performing the RTF projection, wherein the obtaining the speaker RTF for each microphone of the array of microphones other than the reference microphone includes computing, for each of the potential locations, a ratio of an acoustic transfer function of the voice sample at the microphone to an acoustic transfer function of the voice sample at the reference microphone.

2. The method according to claim 1, wherein the obtaining the voice sample is performed in real time.

3. The method according to claim 1, further comprising sampling a sound from each of the potential locations to obtain the set of stored RTFs.

4. The method according to claim 1, further comprising obtaining the set of stored RTFs as the RTF for each microphone of the array of microphones other than the reference microphone based on computing, for each of the potential locations, a ratio of an acoustic transfer function from one potential location among the potential locations to the microphone to an acoustic transfer function from the one potential location among the potential locations to the reference microphone.

5. The method according to claim 1, wherein the performing the RTF projection includes calculating a cosine distance between each speaker RTF and each RTF of the set of stored RTFs.

6. The method according to claim 5, wherein the determining the location of the active speaker is based on the maximum of the cosine distances.

7. The method according to claim 1, wherein the storing the set of stored RTFs for the potential locations includes storing the set of stored RTFs for each seat in an automobile.

8. The method according to claim 7, wherein the storing the set of stored RTFs is part of a calibration process performed for the automobile.

9. The method according to claim 7, wherein the storing the set of stored RTFs is part of a calibration process performed for a calibration automobile of a same model as the automobile.

10. A system to estimate a location of an active speaker, the system comprising:

a memory device configured to store a relative transfer function (RTF) for each microphone of an array of microphones other than a reference microphone associated with each potential location among potential locations as a set of stored RTFs, wherein the reference microphone is any one of the array of microphones; and a processor configured to obtain a voice sample of the active speaker and obtain a speaker RTF for each microphone of the array of microphones other than the reference microphone, perform an RTF projection of the speaker RTF for each microphone on the set of stored RTFs, and determine one of the potential locations as the location of the active speaker based on the RTF projection, wherein the processor obtains the speaker RTF for each microphone of the array of microphones other than the reference microphone based on computing, for each of the potential locations, a ratio of an acoustic transfer function of the voice sample at the microphone to an acoustic transfer function of the voice sample at the reference microphone.

11. The system according to claim 10, wherein the processor obtains the voice sample in real time.

12. The system according to claim 10, wherein the processor samples a sound from each of the potential locations to obtain the set of stored RTFs.

13. The system according to claim 10, wherein the processor obtains the set of stored RTFs as the RTF for each microphone of the array of microphones other than the reference microphone based on computing, for each of the potential locations, a ratio of an acoustic transfer function from one potential location among the potential locations to the microphone to an acoustic transfer function from the one potential location among the potential locations to the reference microphone.

14. The system according to claim 10, wherein the processor performs the RTF projection by calculating a cosine distance between each speaker RTF and each RTF of the set of stored RTFs.

15. The system according to claim 14, wherein the processor determines the location of the active speaker based on the maximum of the cosine distances.

16. The system according to claim 10, wherein the memory device stores the set of stored RTFs for each seat in an automobile.

17. The system according to claim 16, wherein the memory device stores the set of stored RTFs as part of a calibration process performed for the automobile.

18. The system according to claim 16, wherein the memory device stores the set of stored RTFs as part of a calibration process performed for a calibration automobile of a same model as the automobile.

* * * * *